US010235982B2

(12) United States Patent
Prokop

(10) Patent No.: US 10,235,982 B2
(45) Date of Patent: Mar. 19, 2019

(54) MUSIC GENERATION TOOL

(71) Applicant: Sublime Binary Limited, Nottingham (GB)

(72) Inventor: Jennifer Helen Prokop, Nottinghamshire (GB)

(73) Assignee: Sublime Binary Limited, Nottingham (GB)

( * ) Notice: Subject to any disclaimer, the term of this patent is extended or adjusted under 35 U.S.C. 154(b) by 0 days.

(21) Appl. No.: 15/579,175

(22) PCT Filed: Jun. 2, 2016

(86) PCT No.: PCT/GB2016/051632

§ 371 (c)(1),
(2) Date: Dec. 1, 2017

(87) PCT Pub. No.: WO2016/193739

PCT Pub. Date: Dec. 8, 2016

(65) Prior Publication Data

US 2018/0137845 A1 May 17, 2018

(30) Foreign Application Priority Data

Jun. 2, 2015 (GB) ..... 1509532.6

(51) Int. Cl.
*G10H 1/06* (2006.01)
*G10H 7/00* (2006.01)
*G10H 1/00* (2006.01)

(52) U.S. Cl.
CPC ..... *G10H 1/0025* (2013.01); *G10H 7/00* (2013.01); *G10H 2210/161* (2013.01);
(Continued)

(58) Field of Classification Search
CPC ..... G10H 1/0025; G10H 2240/075; G10H 2240/131; G10H 1/361; G10H 2240/145;
(Continued)

(56) References Cited

U.S. PATENT DOCUMENTS 8,119,896 B1 * 2/2012 Smith ..... G09B 15/00 84/470 R
8,686,271 B2 * 4/2014 Wang ..... G06F 17/30861 700/94
(Continued)

FOREIGN PATENT DOCUMENTS

WO 2007076311 A2 7/2007
WO 2009107137 A1 9/2009
(Continued)

*Primary Examiner* — Marlon T Fletcher
(74) *Attorney, Agent, or Firm* — Young Basile Hanlon & MacFarlane, P.C.

(57) ABSTRACT

A system and computer-implemented method for generating music content includes a music notation data store having a collection of notation data files and an audio data store having a collection of audio data files, each data file in the notation and audio data stores including associated music characteristic metadata. One or more computer processor is arranged to receive user music preference inputs from a user interface and to search the notation and audio data stores to identify a plurality of data files corresponding to one or more user preference input. The processor randomly selects at least one notation file and at least one audio file from the identified notation and audio files and generates a music instance file by combining the selected notation and audio files for playback to the user.

16 Claims, 5 Drawing Sheets

(52) U.S. Cl.
CPC . *G10H 2240/075* (2013.01); *G10H 2240/121* (2013.01); *G10H 2240/145* (2013.01)

(58) Field of Classification Search
CPC ..... G10H 1/0033; G10H 2210/101; G10H 2240/125; G10H 1/36; G10H 2210/046; G10H 2210/105; G10H 2210/145; G10H 2240/121; G10G 1/00
See application file for complete search history.

(56) References Cited

U.S. PATENT DOCUMENTS

2002/0162445 A1* 11/2002 Naples ..... G10H 1/365 84/610
2004/0089141 A1* 5/2004 Georges ..... G10H 1/0025 84/609
2004/0194612 A1* 10/2004 Parees ..... G10H 1/00 84/609
2005/0005760 A1* 1/2005 Hull ..... G10H 1/00 84/645
2007/0137463 A1 6/2007 Lumsden
2007/0261535 A1 11/2007 Sherwani et al.
2008/0271591 A1* 11/2008 Lemons ..... G09B 15/023 84/601
2008/0276791 A1* 11/2008 Lemons ..... G10H 1/0008 84/483.2
2009/0064851 A1* 3/2009 Morris ..... G10H 1/0025 84/637
2009/0107320 A1 4/2009 Willacy et al.
2009/0164034 A1 6/2009 Cohen et al.
2009/0231968 A1 9/2009 Ochi et al.
2009/0255395 A1* 10/2009 Humphrey ..... G09B 15/00 84/470 R
2010/0064882 A1 3/2010 Miyajima et al.
2010/0162878 A1* 7/2010 Lengeling ..... G09B 15/009 84/483.2
2010/0162880 A1* 7/2010 Luedecke ..... G09B 15/00 84/645
2010/0313736 A1* 12/2010 Lenz ..... G09B 15/02 84/477 R
2012/0132057 A1* 5/2012 Kristensen ..... G09B 15/00 84/650
2013/0018496 A1 1/2013 Littlejohn
2013/0319209 A1* 12/2013 Good ..... G09B 15/04 84/483.2
2014/0033899 A1* 2/2014 Dripps ..... G09B 5/06 84/483.1
2014/0052282 A1 2/2014 Balassanian
2015/0033932 A1 2/2015 Balassanian
2015/0255052 A1 9/2015 Rex

FOREIGN PATENT DOCUMENTS

WO 2013182515 A2 12/2013
WO 2014028891 A1 2/2014

* cited by examiner

MUSIC GENERATION TOOL

CROSS REFERENCE TO RELATED APPLICATION

The present application claims priority to Great Britain Patent Application No. 1509532.6, filed Jun. 2, 2015, incorporated herein in its entirety.

TECHNICAL FIELD

This disclosure concerns music generation tools, and more specifically, digital music generation tools.

BACKGROUND

The ubiquity of standard digital music formats has allowed online music stores to grow considerably over recent years. Monitoring of musical tastes and buying habits of consumers has allowed development of various software applications that analyse consumer music selections and listening habits so as to be able suggest new music that is likely to appeal to a user. Conventional software tools are also able to identify music files that complement each other, e.g. to played in succession to a user, based on musical genre, style, age, as well as user rankings.

Digital Audio Workstations (DAWs) for generating, editing and mixing music recordings and tracks into a final piece of music are also well known in the music industry. Increasing computational power of conventional computing equipment has seen a significant rise in the use of software DAWs, allowing a variety of conventional music production hardware to be recreated in software format, such that music production tools are more widely available to professional producers and amateurs alike.

Using DAW's it is possible to manually create an almost endless variety of tracks that can be mixed together into a final piece of music. However, even with all these tools to hand, finding the seed of inspiration that can be worked into a final piece of music can be a frustrating and time-consuming endeavour. It is widely acknowledged that listening to music can inspire creation of new music. Even if the bare bones of a new piece of music are found, it can take significant further experimentation to build on a basic sound or sample/loop so as to work up to a cohesive piece of music.

Furthermore, for amateurs in particular, it may be difficult to isolate or recreate a particular sound or loop once it has been heard in a song in a form that can be worked on.

SUMMARY

It is an aim of the present invention to provide a tool for easing or facilitating creation of new music. It may be considered an additional or alternative aim to provide a tool that mitigates one or more of the above-identified problems.

According to an aspect of the invention there is provided a system for generating music content comprising a music notation data store comprising a collection of notation data files, an audio data store comprising a collection of audio data files, each data file in the notation and audio data stores comprising associated music characteristic metadata, and one or more processor arranged to receive user music preference inputs from a user interface and to search the notation and audio data stores and identify a plurality of data files corresponding to one or more user preference input, the processor randomly selecting at least one notation file and one audio file from the identified notation and audio files and generating a music instance file from the combination of the selected notation and audio files for playback to the user.

The processor may generate and/or output metadata with the music instance file. The music instance metadata may provide an auditable record for the notation and audio files used in the music instance generation. The processor may store/log the music instance file with, e.g. comprising, the generated metadata.

The processor may log the user preference inputs resulting in the music instance generation with the generated music instance file, e.g. as metadata for the music instance file or as a separate record accompanying the music instance file.

The processor may reduce the number of identified data files subjected to the random selection process. The processor may filter, e.g. by selecting a subset of, the identified plurality of notation and/or audio data files prior to randomly selecting the at least one notation file and/or one audio file from the identified files. Selectively/optionally reducing the available data files subjected to the random selection process may beneficially allow the degree of randomness to be altered/controlled. This may be useful in avoiding entirely unsuitable combinations of notation and audio file whilst still permitting novel music instance generation. Searching of audio files may comprise searching the audio files based upon one or more metadata parameter of a selected notation file.

Additionally or alternatively, the processor may analyse the generated music instance to assess its acceptability prior to, or after, outputting the generated music instance to the user. The processor may score or rank the acceptability of generated music instance files. In this way the perceived randomness of the music instance files presented to the user can be controlled so as to avoid entirely unsuitable music instance candidates being proposed. An analytics module may score a generated music instance file according to user interaction with the file after it has been generated. This may allow feedback of the success of the music generation process such that the control of the filtering process can be updated.

Filtering of the results of the music generation process can thus be performed pre and/or post the random selection process. The processor may generate music instance files based on a random selection process but may output or store only a selection or subset of the generated music instance files, e.g. which are made accessible to the user for playback.

The system may allow implementation of a randomness parameter, e.g. by user selection of a randomness parameter via the user interface and/or by determination of a suitable randomness parameter from one or more other user inputs.

The system may generate a plurality of output music instance tracks from the identified data files, e.g. for a single user request or set of user music preference inputs The system may automatically generate a plurality of music instance files from the identified data files, e.g. for a single user request or set of user music preference inputs. Each generated music instance file may comprise one or more generated instance track.

The processor may assess the generated metadata of each generated music instance or track thereof. The processor may assess one or more similarity/match criterion between a plurality of generated music instance files or tracks. If a match or similarity criterion for a plurality of generated music instance files or tracks is established by the processor, the processor may discard one or more of said plurality of generated music instance files or tracks. The processor may thus ensure the uniqueness or diversity in the music instance files output to the user.

The notation data files may comprise machine readable instructions and/or parameter data for controlling music playback. The notation data files may comprise notation tracks, e.g. with each notation data file comprising one or more notation track. Notation data files or tracks may comprise data representing any or any combination of music playback control parameters, such as timing, pitch, duration and velocity.

Notation data files or tracks may comprise any or any combination of notation data (e.g. a sequence of notes), timing, pitch, duration and/or tempo parameter data, e.g. as opposed to a musical recording itself. Notation data files may be interpreted as melodies to be played by a single instrument, or a rhythmic pattern to be played by multiple instruments, for example wherein each pitch represents a different instrument.

The notation data files may comprise MIDI files or equivalent music/notation playback instruction file format. Notation files may comprise groupings of notation tracks representing a piece of music.

The music characteristic metadata may comprise one or more music category. The characteristic metadata or music category may comprise any or any combination of: a music type, genre, style or emotion, an instrument type and/or one or more measurable/numerical parameter, such as frequency, pitch, duration, bit rate, sample rate or number of channels.

Notation metadata may comprise data representing categorisations of notation data files or tracks. Categorisations of notation files may include the style of music represented by the notation file, the file description, the file name, the type of instrument or technical/parameter data relating to the file, for example parts per quarter or any other numerical/numerical range or descriptive parameter indicator corresponding to a technical quality of a track, such as tempo, pitch, etc.

The audio data files may comprise audio content (e.g. a bitstream and/or an audio recording) coded according to a recognised audio coding format. Conventional compressed or uncompressed audio file formats may be used, such as, for example WAV files. The audio data files in the store may each represent a, typically short, instrument sample, such as a one-shot sample.

Audio metadata may comprise technical data relating to each audio file, which may include any of frequency, pitch, duration, bit rate, sample rate, file type, file size or number of channels. Audio metadata may comprise data representing categorisations of audio files, which may include any of instrument, instrument family, name, description or genre.

According to examples of the invention, one or more audio data file may be combined with one or more notation file, for example by overlaying or inserting audio into, or in accordance with, the notation file. The audio file may be inserted in parallel with the notation file. The resulting/generated music instance file may be of length/duration, or other parameter, which substantially matches that of the notation file. The audio file may comprise a sample to be inserted into the resulting/generated file according to notation data of the notation file. The notation file may comprise one or more track.

Parameters input by the user may comprise any, or any combination of: metadata classification tags, track count, output count, stereo width, randomness, beats per minute, length, tonality, frequency, pitch, root note or volume. Track count may comprise a number of tracks required for a generated music instance. Output count may comprise a number of music instance files to be generated. Stereo width may comprise a value or set of values representing the amount of panning to be applied to each track of the generated music instance. A randomness parameter may comprise a value or set of values representing the extent to which constituent parts of the output music instance will be chosen at random, e.g. by filtering pre or post random selection. A length parameter may comprise the length of the music instances to be generated. A tonality parameter may comprise a value representing the extent to which the generated music instance may be melodic or atonal. The tonality parameter may or may not comprise a value representing the extent to which each instrument in the generated music instance may be melodic or atonal. A frequency parameter may comprise a range of frequencies for the generated music instance, or may comprise a single value of frequency or a range of frequencies for each instrument in the generated music instance. A pitch parameter may comprise a range of pitches for the generated music instance, or may comprise a single value of pitch or a range of pitches for each instrument in the generated music instance. A root note parameter may comprise a root note for any melodic components, which may be single or multiple values for the generated music instance, or single or multiple values for each instrument in the generated music instance. A volume parameter may comprise relative or absolute volumes for each track of the music instance.

The generated music instance may comprise a loop.

The system for generating music content may comprise an output store. The output store may comprise audio data files representing the generated music instances. The output store may comprise audio data representing each generated audio track of one or more music instance. The output store may comprise a representation of the notation file of the music instance. The output store may comprise a representation of each audio file used to generate each track of the music instance. Any or any combination of such files may be stored with the corresponding generated music instance file, e.g. in a common data container/folder.

Output music instance file metadata may comprise a portion, or all of, the notation data file and/or audio data file metadata of the notation and/or audio data files selected in the music instance file generation process, or an identifier thereof. Output music instance file metadata may include one or more user input parameter, or an identifier thereof.

Output music instance file metadata may comprise data representing categorisations of each generated audio track, the generated music instance file itself and/or the selected notation and/or audio data file. Categorisations may comprise any or any combination of instrument, instrument family, name, description, musical genre or emotion or type, frequency or frequency range, or pitch or pitch range.

Output music instance file metadata may comprise technical/parameter data each generated music instance or constituent notation/audio data file used in the generation thereof, which may include any or any combination of frequency range, pitch range, duration, bit rate, sample rate, file type, file size or number of channels.

The system may comprise a notation module. The notation module may create a selectable notation data file from stored notation data, e.g. based on user input parameters. The system may comprise a notation generator. The notation module may create a selectable notation file from the notation generator output, e.g. based on user input parameters.

The system may comprise a sound module. The sound module may create a selectable audio data file, e.g. an audio data set, from stored audio data, e.g. based on user input parameters. The system may comprise a synthesizer module. The sound module may create a selectable audio data file from the synthesizer module output, e.g. based on user input parameters.

The system may comprise an effects module. Based on input parameters, the system may apply effects to each generated audio file, from the effects module.

Parameters input by the user may further comprise synthesizer parameters. Synthesizer parameters may include any of oscillator count, oscillator type, filter type, filter frequency and resonance or low frequency oscillator parameters. Parameters input by the user may further comprise effects parameters. Effects parameters may further comprise any of reverb parameters, delay parameters, equalisation parameters, compression parameters or filter parameters.

According to another aspect of the invention there is provided a method of generating music content corresponding to the system of the first aspect.

Searching notation metadata based on input parameters may comprise searching a database for notation files comprising metadata matching user input parameters. User input parameters may use any of the categorisations within the metadata. User input parameters may comprise specified genres and instruments. Searching notation metadata may comprise returning notation files.

The number of notation files returned in the search from which the notation tracks are selected may be based on the value of the randomness parameter. For example, a high randomness parameter may result the selecting of notation tracks from multiple notation files, whereas a low randomness parameter may result in the selecting of notation tracks from one notation file.

The number of tracks to select may be based on a user input parameter. The largest number of multiple notation files from which to select notation tracks may be equal to the number of tracks.

According to a further aspect of the invention, there is provided a data carrier comprising machine readable code for operation of one or more computer processor to generate music content by receiving one or more user music preference input, searching a music notation data store comprising a collection of notation data files and an audio data store comprising a collection of audio data files, wherein each data file in the notation and audio data stores comprising associated music characteristic metadata and the searching comprises searching for metadata corresponding to the one or more user music preference input, identifying a plurality of data files corresponding to one or more user preference input, randomly selecting at least one notation file and one audio file from the identified notation and audio files, and generating a music instance file from the combination of the selected notation and audio files for playback to the user.

Any of the optional features defined in relation to any one aspect of the invention may be applied to any further aspect of the invention, wherever practicable.

DESCRIPTION OF THE DRAWINGS

Working embodiments of the invention are described in further detail below with reference to the accompanying drawings of which.

DETAILED DESCRIPTION OF THE EMBODIMENTS

The invention concerns systems and methods by which music files can be output at least pseudo randomly in a format which is manipulable by a user for use in creating a piece of music. The invention resides generally in the storage of different music file types in a controlled/structured manner, coupled with a tool to combine different file combinations to create elements of a music instance, wherein the files selected for use are randomly selected from subsets of the available files in the databases.

Figure 1:
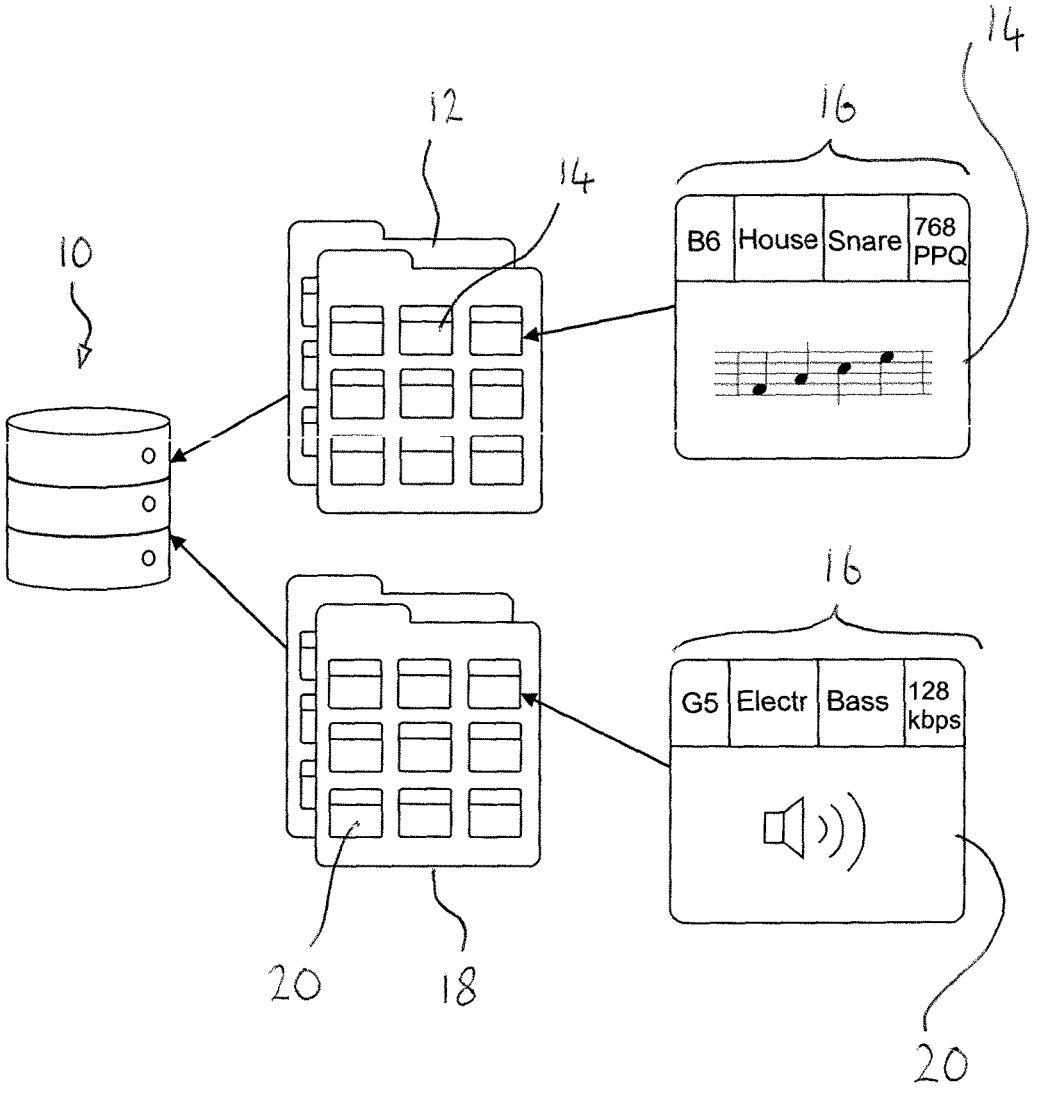
FIG. 1 shows a schematic data store according to an example of the invention.

Turning firstly to FIG. 1, there is shown a data store 10 for use in conjunction with the present invention. The data store 10 typically comprises one or more conventional, non-volatile data storage device, such as a hard disk/drive, flash/solid-state memory device and may make use of any conventional magnetic, semiconductor, optical or other equivalent or suitable memory storage technology. A conventional enterprise-scale storage solution may be employed, for example within a data centre.

The data storage device 10 has stored thereon a first database 12 comprising a collection of music notation files 14. Each notation file comprises machine readable instructions, which—when executed by a suitable processor/machine—control playback of one or more music notation track. Each notation file comprises data indicating a series of musical notes to be played. A notation track may be interpreted as a melody to be played by a single instrument or a rhythmic pattern to be played by multiple instruments. The one or more instrument for each music notation file may be characterised by pitch data, e.g. wherein each pitch represents a different instrument. Typically each notation file comprises one or more grouping of notation tracks representing a piece of music.

Accordingly each notation file 14 may comprise playback data comprising any, any combination, or all of pitch, duration, speed (e.g. beats per minute) and/or timing data representing one or more notation track for a piece of music. A velocity parameter may additionally or alternatively be used e.g. to control playback intensity/volume.

The format of such notation files is conventionally standardised for interpretation/playback by multiple devices according to one or more protocol. An example of a notation file is a MIDI file, although it will be appreciated by the skilled person that alternatives may be used if required, such as Open Sound Control.

The data storage device 10 further comprises a second database providing an audio data store 18. In contrast to the notation database 12, the audio data store 18 comprises a collection of audio data files 20. Audio data files comprise a bitstream in an audio coding format representing an audio recording, i.e. comprising digital audio data. Various audio file formats will be known to the skilled person and may comprise uncompressed digital audio or various different formats of compressed digital audio as necessary. Uncompressed file types, such as WAV files, or lossless compression formats are preferred in line with the provision of a music generation tool that can be used professionally, although lossy compression formats, such as MP3, AAC and the like could potentially be used if required according to data compression requirements.

Audio data files 20 may represent an audio sample, such as a "one shot" sample or a short piece of music. The audio data files may each represent one or more recognisable instrument, such as a snare drum, bass drum, piano, guitar, etc.

The collections of the different types of files referred to above typically comprises tens or hundreds or even thousands of files. Whilst the invention may be used for smaller collections, the invention is particularly beneficial when the collections are of significant size so as to represent a wide variety of genres, instruments, tempo's etc.

The data storage device 10 may or may not be partitioned to accommodate the different types of databases described above. Whilst a single data store 10 is described above as comprising the relevant databases thereon, it will be appreciated that a plurality of data storage devices could be provided in other examples of the invention. Such devices could be commonly located or housed at different locations, provided the data content of each store is accessible substantially concurrently, e.g. in real time by a device running the music generation tools to be described below.

In addition to the 'core' file data representing the functional musical element, each notation 14 and audio 20 file comprises respective associated metadata 16. The meta data is shown as being attributed, i.e. stored with, the associated file in the database. In other examples, the metadata could be stored and administered in a further metadata repository or store, i.e. the notation and audio metadata repositories 12*a* and 18*a* respectively shown in FIG. 4.

Notation Metadata may consist of any or any combination of:

Data representing categorisations of notation tracks. Possible categorisations may include: an indicator of the type of instrument the track represents e.g. snare drum; a track description; a track name Data representing categorisations of notation files. Possible categorisations may include: the style of music the notation file represents e.g. pop; file description; file name; and/or technical data relating to the file. The technical data may comprise any of the technical parameters described herein, including one or more parameter for categorising a quality of the sound and/or one or more parameter to categorise a quality of the file type. An example of one such parameter is parts per quarter (PPQ).

Each notation file and/or associated metadata typically comprises timing data or timing event data, for example being indicative of the tempo, beats per minute (bpm) or other related attribute of the notation file.

Audio metadata may consist of any or any combination of:

Technical data relating to each audio file. The technical audio metadata preferably comprises one or more parameter used to categorise an attribute of the sound, such as frequency/pitch, wavelength, wave number, amplitude. Additionally or alternatively, the technical audio metadata may comprise one or more parameter used to categorise a quality of the bitstream, i.e. the digital audio quality. The technical audio data may comprise but is not limited to any or any combination of: frequency: pitch; duration; bit rate; sample rate; file type; file size; number of channels i.e. 1 for mono, 2 for stereo, or more.

Figure 2:
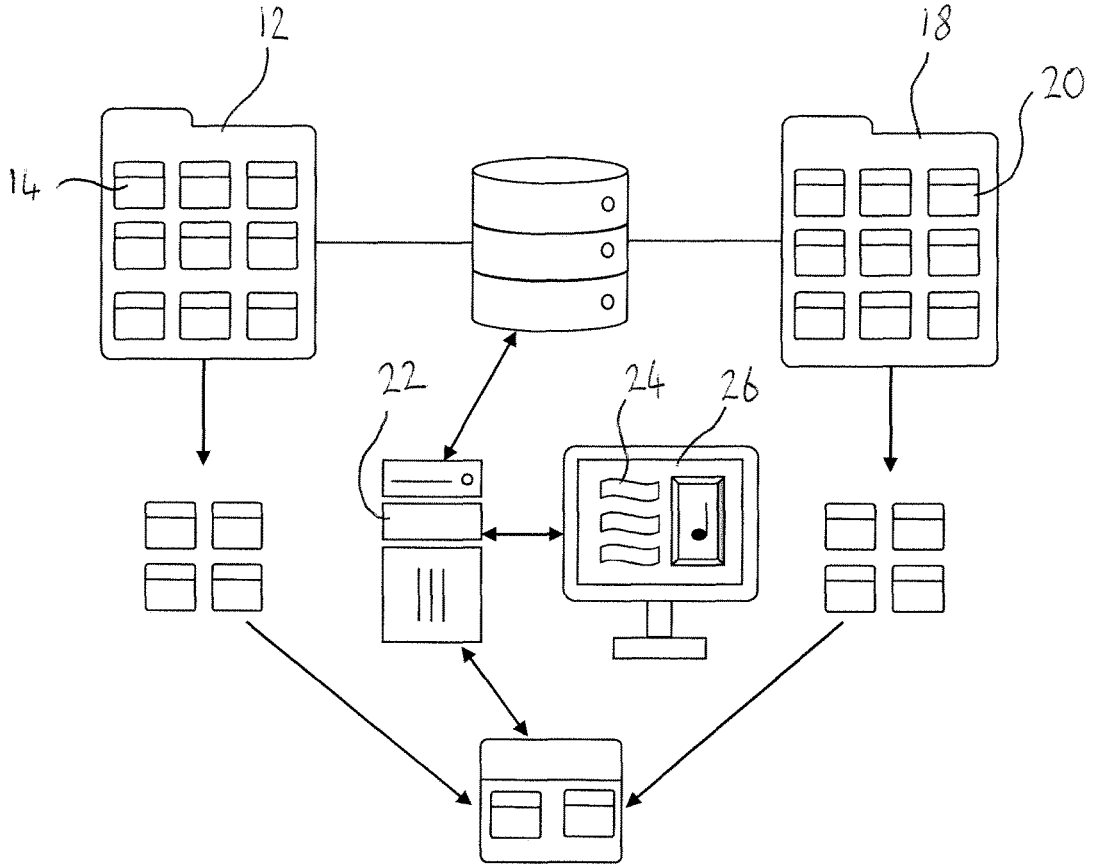
FIG. 2 shows a schematic of a music generation system operating in accordance with an example of the invention.

Data representing categorisations of audio files. Possible categorisations may comprise any or any combination of: an instrument indicator e.g. snare drum; an instrument family indicator e.g. percussion; a name; a description; and/or a style of music e.g. pop Turning now to FIGS. 2-4, there are shown examples of a system according to the present invention in which the data store 10, including the databases 12, 18 thereof are accessible to suitable data processing equipment so as to facilitate a music generator tool 22 for operation by an end user. The processing equipment, typically comprises one or more programmable data processor, such as one or more computer chip, arranged to receive user inputs 24 from a user interface 26 and to access the notation and audio databases for retrieval of files therefrom in response to the user inputs 24. The processing equipment may comprise a server, PC, tablet, laptop, smartphone or any other conventional computing general purpose equipment programmed with machine readable instructions for operation in accordance with the present invention. Alternatively, the invention could comprise bespoke computing hardware/equipment in other examples.

The processing equipment communicates with the data store 10 via a wired or wireless connection and may be connected thereto, for example using a data bus within a common hardware housing, or else over a local area or wide area connection. The invention thus accommodates any combination of local or remote database storage with respect to the processing performed by the music generation tool 22 itself. Similarly the processing required for music generation may be local to the user input means or remote therefrom. The processing equipment could thus be cloud/server based if desired.

Figure 4:
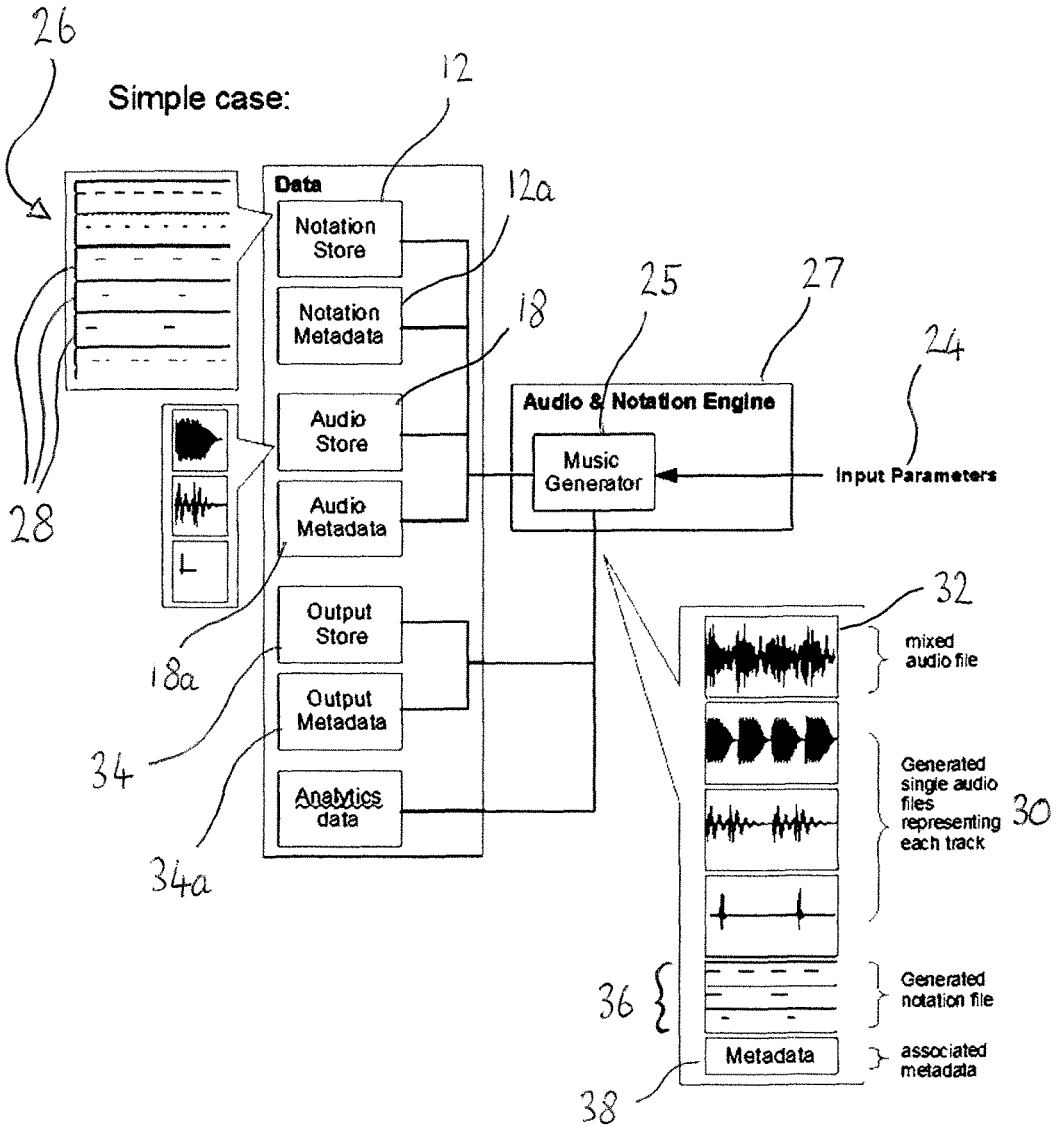
FIG. 4 shows a schematic flow chart of use of a system according to an example of the invention.
Figure 5:
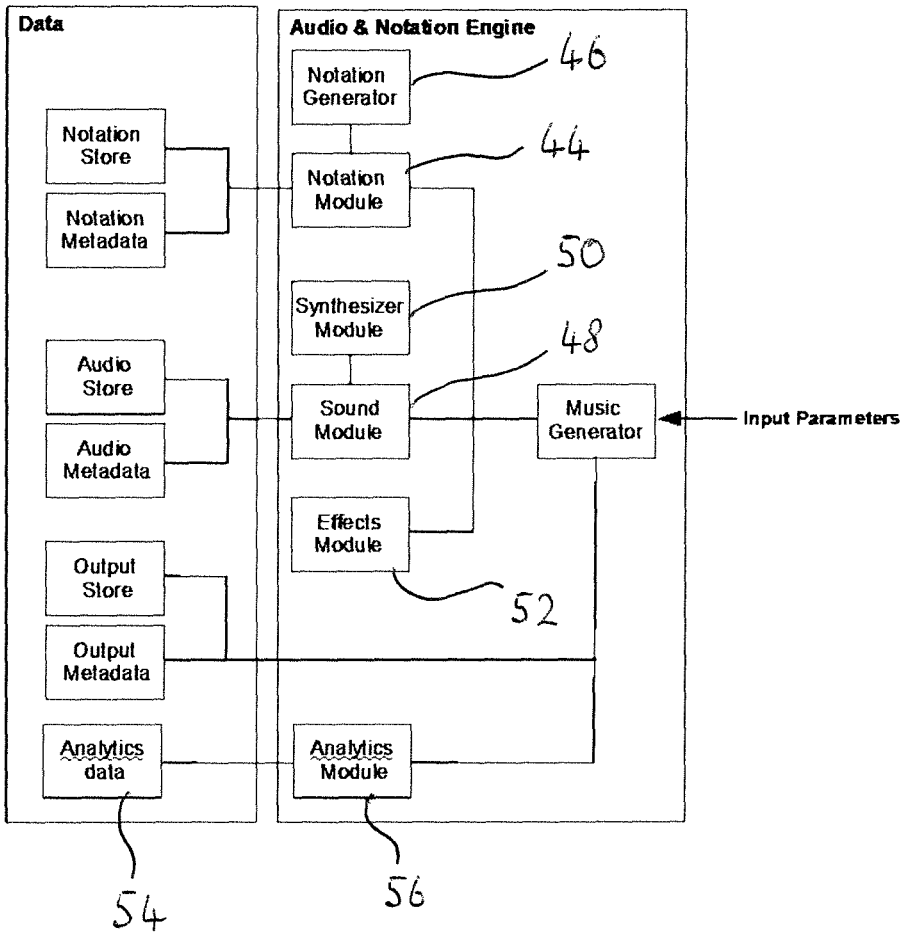
FIG. 5 shows an example of a larger music generation system incorporating a system according to an example of the invention.

As shown in FIG. 4, the music generation application/module 25 creates and outputs the music instances in response to the user inputs. This application/module function receives its inputs in the form of notation and audio inputs from the associated application/module 27, shown in FIG. 4 as the audio & notation engine—i.e. the application component responsible for searching and retrieving the relevant notation and audio inputs for the music generator module 25 based on the user inputs. Those modules may each contribute to aspects of the invention but are collectively referred to as the music generation tool 22 herein for conciseness.

The user interface 26 in this example is provided on a display screen comprising virtual controls on screen but could otherwise be implemented in part or entirely using physical controls. The user can input via the user interface 26 parameters to control either or both of: a search of the notation/audio databases for suitable candidate files to use in the generation of one or more music instance and/or one or more degree of freedom with which candidate notation/audio files can be combined in generating the one or more music instance. User interface controls may comprise any or any combination of, dials, knobs, alphanumeric input, and/or selections of predetermined options, e.g. by way of a drop-down selection box.

In some examples, the processing equipment for music generation could be called by other processing equipment, instead of user interface 26, e.g. allowing the system to provide an application program interface.

The user input parameters may comprise or consist of any or any combination of:

One or more classification tag identifying a selection of one or more music style, genre or instrument for the generated music instance or one or more track thereof Track count: how many tracks each generated music instance should contain Output count: how many music instances to generate Stereo width: A value or set of values representing how much panning to apply to the generated audio tracks Randomness: A value or set of values representing how much the constituent parts of the output will be chosen at random, e.g. by limiting the subset of files from which a random selection is made Beats per minute Length: length of the music instances to generate Tonality: A value representing how melodic or atonal melodies generated will be, this may be defined per instrument or for the generated music instance Frequency: frequency may be defined as a single value or a range for each instrument or as a range for the generated music instance Pitch: pitch may be defined as a single value or a range for each instrument or a value/range for the generated music instance Root note: the root note of any melodic components, which may be defined as a single or multiple values for each instrument or as single or multiple values for the generated music instance.

Volume: relative or absolute volumes for each track

The user inputs 24 are received and processed by the music generator tool 22. In order to return one or more music instance in response to the user inputs, the music generator is performs the following:

Based on the input parameters 24, the music generator performs a search of the notation and audio metadata, to identify the set of matching notation and audio metadata—i.e. to identify candidate notation and audio files for the music generation process according to their metadata.

The notation metadata 12*a* is searched initially, followed by the audio metadata 18*a*.

The metadata may be searched using any of the metadata parameters/types described herein. However it is preferred that one or more metadata parameters are defined as being core matching parameters between notation and audio metadata, i.e. to define which of the candidate notation tracks can be used with which candidate audio file. In this example, a core match is determined based on instrument selection and musical style/genre. A simple distinction may thus be made between the user input criteria which define metadata for searching the notation/audio databases and the core metadata parameters used for matching notation and audio in generating the music instances for output to the user.

Whilst the instrument and music style/genre metadata fields have been found to provide a useful general purpose music generation tool, it is possible in other embodiments that other parameters could be used, for example if the user is allowed to preselect a specific genre or if the tool is set up to work only within a specific genre (e.g. pop, indie, R&B, or the like) then the match on musical genre would no longer be required and an alternative matching metadata parameter could be used.

The notation database 12 is searched for matching notation metadata 12*a*, based the specified user input parameters 24. The full set of matching notation metadata is returned to the music generation application. If no matching notation metadata is found, the generation process will terminate and output a message to the user of the result. Provided matching notation metadata is found, the music generation application processes the metadata automatically as discussed below.

From the set of matching notation metadata, a set 26 of the notation tracks 26 is selected to generate a notation file. The notation tracks 28 may be taken from one or more notation files 14 in the notation store. It will be appreciated that each notation file 14 in the database can contain one or more notation track 26. The number of tracks/files selected in this example is based on the size of the "randomness" parameter or other characteristics of the input parameters. The size of the notation track set is equal to the number of tracks for this music instance requested in the input parameters.

The application determines how many different notation files 14 to pick notation tracks from based on the value of the randomness parameter. A low randomness value will result in notation tracks being picked from just one notation file, a high randomness value will result in notation tracks being picked from a plurality notation files, with the highest number of notation files to pick from being equal to the number of tracks requested.

Once the candidate notation files have been determined, along with the number of tracks to be selected, and the number of notation files from which those tracks can be selected, the music generator makes a random selection of tracks/files from the candidate metadata and repeats the process until the predetermined number of notation tracks has been reached. To this end, the application creates new notation metadata in the music generator memory (typically non-volatile) and/or data store 10, to hold the selected set of notation track metadata from within the candidate notation metadata returned from the search. All the candidate notation metadata returned by the search may also be stored, e.g. for repeat searching/selection. Thus, whilst the pre-filtering of search results can be performed, the notation tracks to be implemented are ultimately picked at random from the set of notation metadata tracks returned from the search. Accordingly, the selection process may be defined as a pseudo-random process.

From the notation metadata created, the specified notation tracks are loaded into the music generation module 25 from the notation files 14 held in the database 12.

Example 1

Input Parameters: Genre=House, Instruments=Kick, Hi Hat, Snare, Percussion, NumberOfTracks=4, Randomness=0

Number of notation files returned in search: 2

Number of notation files to pick notation tracks from: 1

Notation metadata result: All 4 tracks are picked from 1 notation file.

Example 2

Input Parameters: Genre=House, Instruments=Snare, Percussion, NumberOfTracks=3, Randomness=0

Number of notation files returned in search: 2

Number of notation files to pick notation tracks from: 1

Notation metadata result: All 3 tracks are picked from 1 notation file. The 2 notation tracks categorised as Snare and Percussion in the metadata are used. The $3^{rd}$ notation track to use is picked at random.

Example 3

Input Parameters: Genre=House, Instruments=Snare, Percussion, NumberOfTracks=4, Randomness=100

Number of notation files returned in search: 2

Number of notation files to pick notation tracks from: 2

Notation metadata result: All 4 notation tracks are picked from the 2 notation files at random. Tracks which are categorised as Snare and Percussion are picked first from either file. The other 2 notation tracks are picked at random from either file.

A list of audio metadata to search for (i.e. the audio search criteria) may be created by the music generation tool 22, i.e. application 27 in FIG. 4. In this example, the tool specifies which audio instrument will be used for each notation track, although additional or alternative metadata parameters could be used as discussed herein. This audio metadata search list is based on the instruments specified by the notation track metadata selected in the previous step and conforms to the genres specified in the initial search. Depending on the particular scenario, the tool may or may not modify/supplement the initial user inputs with one or more parameter derived from the notation search results, i.e. the metadata of the selected notation tracks/files.

When the randomness parameter is nil or sufficiently low, the instruments/parameters specified by the notation track metadata will be exactly the instruments used to specify the audio instruments and each generated track will have the same notation and audio instrument/parameter.

When the randomness parameter is higher, one specified notation instrument/parameter value will be replaced with a randomly selected audio instrument/parameter value. When the randomness parameter is high enough audio instrument/parameter values for a plurality, or all, notation tracks may be swapped for an alternative audio instrument/parameter value, resulting in different instruments used in actuality than those specified by the notation track metadata. At a maximum randomness setting, potentially no audio and notation instrument/parameter values will match.

The audio metadata is searched to find the set of matching metadata for each instrument/parameter value, e.g. conforming to the specified genres. From this set of candidate audio files, an audio metadata item for each audio instrument is selected at random, thereby specifying the audio data/file(s)/sample(s) to be used to accompany the notation track(s) in music instance generation. The size of this selected subset is equal to the number of tracks requested in the input parameters. Thus each sample corresponds to a notation track in the generated notation file.

The audio data/samples specified by the selected audio metadata are loaded in to the music generation module 25.

Example 1

Input Parameters: Genre=House, Instruments=Kick, Hi Hat, Snare, Percussion, NumberOfTracks=4, Randomness=0

| User Specified Instrument | Notation Track Instrument | Audio Instrument Selected |
|---|---|---|
| Kick<br>Hi Hat<br>Snare<br>Percussion | Kick<br>Hi Hat<br>Snare<br>Percussion | Kick<br>Hi Hat<br>Snare<br>Percussion |

Example 2

Input Parameters: Genre=House, Instruments=Snare, Percussion, NumberOfTracks=3, Randomness=0

| User Specified Instrument | Notation Track Instrument | Audio Instrument Selected |
|---|---|---|
| Snare<br>Percussion | Snare<br>Percussion<br>Hi Hat | Snare<br>Percussion<br>Hi Hat |

Example 3

Input Parameters: Genre=House, Instruments=Snare, Percussion, NumberOfTracks=4, Randomness=100

| User Specified Instrument | Notation Track Instrument | Audio Instrument Selected |
|---|---|---|
| Snare<br>Percussion | Snare<br>Percussion<br>Hi Hat<br>Kick | Bass<br>Snare<br>Percussion<br>Hi Hat |

A set of generated music instance files, typically in the form of generated audio data files, is now produced by the music generator 25 using the following approach.

The set of selected notation tracks is read into memory. The music generator iterates through the set of notation tracks. The audio data/sample corresponding to the current notation track is read into memory.

For each notation track an output audio data file is created in memory of length that may be specified in advance, e.g. according to the user input parameters. For each timing event in the notation track, a corresponding audio sample is written at the appropriate point in the generated audio data file. Thus audio samples are timed according to the instructions of the notation track.

The notation track or file may thus define a melody to be 'played' by the audio files/samples. In this regard, the audio samples may be considered to be akin to instruments which play out the intended notation sequence at the relevant timings, e.g. at timed notation events. The notation data may define the pitch, tempo and duration of the audio samples to be inserted into the resulting music instance file.

This results in a set of generated audio data files 30, i.e. according to the number of notation tracks 28 used, representing each track of the generated music instance. Thus the music generator converts input notation tracks 28 to output audio tracks 30, which may be stored.

A further audio data file 32 of length requested in the input parameters is created in memory to hold the mixed audio data of all the output audio tracks 30. This may be written by reading each generated audio data file into memory and performing appropriate arithmetical and byte operations on each array of bytes of data of each file to produce a "mixed" array of bytes (bitstream) of data, which is then written into the mixed audio data file. That audio data file 32 may represent the music instance itself, with the other associated files 30 representing elements thereof.

Further audio files may be generated from the set of generated audio files, in compressed format e.g. mp3, or other formats, from the master output format.

A multi-channel audio file may be generated which may contain each generated audio track on a separate channel, or may contain mixed subsets of generated audio tracks, mixed according to instrument type e.g. the stems audio format. Thus separate channels could be generated for different instrument types or other metadata parameters disclosed herein.

A visual representation of each audio file 30 and/or 32 may be generated as shown in FIG. 4 and output for display to the user via the interface 26 or storing alongside the music instance data.

According to aspects of the invention, prior to creating and/or outputting a generated music instance, the music generation tool may search the output metadata (i.e. the combined meta data of the selected notation and audio tracks/files to ensure the selected set of notation and audio metadata do not have the same metadata "fingerprint" as previously generated music instances. If a matching output metadata is found, the steps above may be repeated until no output metadata with the same metadata "fingerprint" is found.

In order to co-ordinate the output music instance data and associated files/metadata, the music generator creates an output data entity within an output store 34 in the data store 10, local memory or for transmission to another data storage device. The output store comprises an ordered set of records of music instances generated by the application/tool and the associated metadata. The metadata may be stored with the music instance file itself or in a separate output metadata store 34*a* corresponding to the output audio.

The output data store may thus comprise any or any combination of:

- Audio data file 32 representing the generated "music instance" which may be a short/single loop, or a longer piece of music
- Audio data files 30 representing each generated track of the music instance
- A representation 36 of the notation file of the music instance
- A representation of each audio file used to generate each track of the music instance
- Any associated metadata The set of output metadata may be generated from any of the metadata types/parameters discussed above in conjunction with the audio and/or notation files, for example by selecting appropriate data from the set of matching notation and/or audio file metadata selected by the searching process. This may include the technical metadata discussed above. In addition to, or instead of technical metadata parameter values accompanying the notation/audio, the music generator may calculate technical metadata for the output audio files from the set of matching audio/notation metadata used in the music generation process and/or by calculating technical parameters from the generated audio files (i.e. the generated audio tracks and/or music instance file) themselves. For example, the music generator could determine and store any of the technical audio parameters discussed herein, which may have been used in the audio track/file generation process.

The set of output metadata may be written to the output metadata 34*a*, e.g. at the same time as the generated notation file, audio files, compressed audio files and/or visual representations are written to the output store.

Examples of possible output metadata include any or any combination of data representing categorisations of each generated audio track and/or music instance, such as: instrument type; instrument family e.g. percussion; name; description; style of music the track represents e.g. pop; frequency or frequency range; pitch or pitch range, and/or technical data relating to the notation file or music instance e.g. PPQ (parts per quarter), frequency range, pitch range, duration, bit rate, sample rate, file type, file size, or number of channels.

The output notation metadata is stored containing the identifiers of the original notation metadata so there is a trail between the original notation metadata and the output metadata. Examples are provided in tabular form below.

Output Notation Metadata

| ID | Original Notation IDs | GENRES |
|---|---|---|
| 1 | 1, 2 | House, Techno |

Output Notation Track Metadata

| ID | Output Notation ID | Original Track ID | Original Notation ID | Instrument |
|---|---|---|---|---|
| 1 | 1 | 1 | 1 | Kick |
| 2 | 1 | 2 | 1 | Hi Hat |
| 3 | 1 | 7 | 2 | Snare |
| 4 | 1 | 8 | 2 | Percussion |

The output audio metadata is stored containing the identifiers of the original audio metadata so there is a trail between the original audio metadata and the output audio metadata.

Output Audio Metadata

| Output ID | Original ID | GENRE | INSTRUMENT |
|---|---|---|---|
| 1 | 3 | House | Snare |
| 2 | 4 | House | Percussion |
| 3 | 5 | Techno | Kick |
| 4 | 6 | Techno | Hi Hat |

This allows the system to check if a notation metadata and audio metadata combination has previously been generated and output by the system. If the metadata searching and processing steps produce a combination of notation track metadata Ids=1, 2, 7, 8 and audio metadata 3, 4, 5, 6 the system checks and finds this is not a unique combination and may generate other combinations until a unique one is found.

The allowed search criteria for permissible combinations of the elements in the data store are simply that the set of notation metadata and the set of audio metadata that contain intersecting genres and instruments.

For the above example, house and techno may be searched on, as may kick, hi hat, snare and percussion. Bass and Electronica may not be searched on as there is no notation metadata with which it could possibly be matched. The application itself may choose the Bass/Electronica audio metadata when the randomness value is high enough, but otherwise it will not be used.

The application and database could initially hold no rules for successful combinations of elements of the data store. The user may indicate to the system a loop is successful by buying it (or with a 'like' button, or star rating system, or simply by listening to the output music instance a plurality of times).

Once bought, the system stores the loop's metadata in flattened form as follows:

Genres and Instruments are encoded using an alphanumeric character into a string, for example:

| GENRE | Code |
|---|---|
| House | A |
| Techno | B |
| Electronica | C |

| Instrument | Code |
|---|---|
| Kick | A |
| Hi Hat | B |
| Snare | C |
| Percussion | D |
| Bass | E |

The above example output metadata would be encoded to produce a genre string representing house and techno and an instrument string representing kick, hi-hat, snare and percussion for both audio and notation metadata. The maximum number of genres or instruments that could possibly be used is the same as the number of tracks the system will allow. If this is 8, then the string will be 8 characters long, with 0s to represent empty genre/instrument.

| Audio Genre Code | Audio Instrument Code | Notation Genre Code | Notation Instrument Code | Count |
|---|---|---|---|---|
| AB000000 | ABCD0000 | AB000000 | ABCD0000 | 1 |

This encoding allows the system to store a count of combinations of genres and instruments of successful loops. This can be stored at the system level and at the user level. The combinations with the highest count can be interpreted as the most successful. Once enough analytics data has been collected, the system may allow loops to be generated based solely on the analytics data, without specifying any further input parameters.

Figure 3:
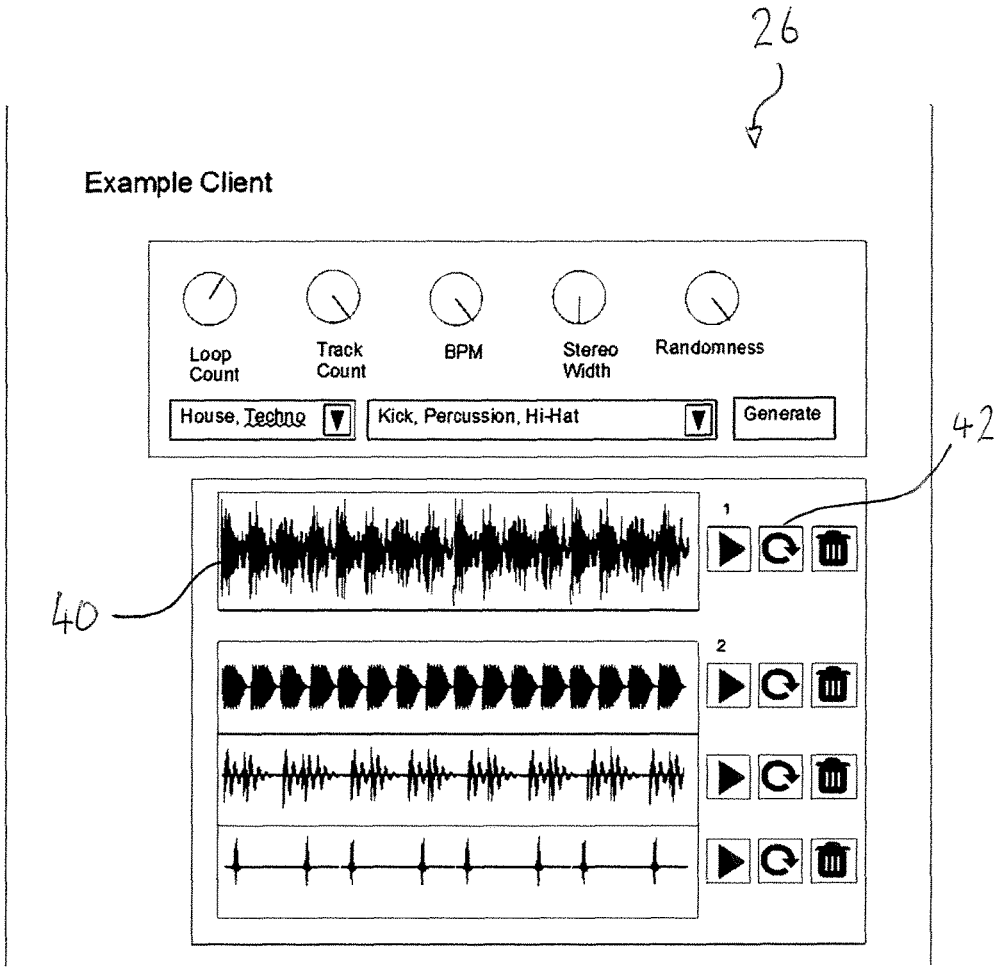
FIG. 3 shows an example of a user interface for use in conjunction with an example of the invention.

Once the output audio files for the generated music instance have been created, the tool 22 makes the music instance audio file available for playback to the user. As shown in FIG. 3, this may be achieved by providing user playback controls 42 for each returned music instance, and/or the audio tracks thereof, within the user interface 26.

A graphical display of the visual representation 40 may be output to the user interface, e.g. which may advance upon playback of the relevant audio file.

In the event that a plurality of music instance files were created in line with a user request, they may be displayed simultaneously in a predetermined order/arrangement on screen, or else may be displayed for playback sequentially.

A user can select to play, regenerate, keep or delete each audio file as desired. Selecting a particular music instance audio file, may provide the option to access and/or play the associated audio tracks, audio sample and/or notation tracks. This approach is particularly useful in allowing a user to reuse the generated music instance in producing a further musical work, or else extracting elements thereof for further refinement, looping, reuse in a larger work and/or refinement using production tools.

The regenerate option, once selected, causes the music generation system to iterate the music generation process but using the previously selected/generated notation data. Thus the music system can revisit the audio data selection and implementation process to achieve a different outcome for the user.

In addition to the core concepts described above, a working implementation of the invention may also accommodate creation of notation or audio files/tracks for storing in the data store 10. Accordingly, the music generation tool may comprise one or more of a notation module 44, a notation generator 46, a sound module 48, a synthesizer module 50 and/or an effects module 52.

Based on input parameters, the notation module 44 can create a notation file 14 from stored notation data and/or from the notation generator 46.

Based on input parameters, the sound module 48 can create a set of audio data from stored audio data 20 and/or from the synthesizer module 50.

Based on input parameters, the music generator may apply effects to each generated audio file, from the effects module 52. Since synthesizers, notation generators and effects applications are generally known in the art, they will not be described in functional detail here for conciseness.

Additional input parameters in light of such additional options may include, on either a 'per track' or 'per music instance' basis:

synthesizer parameters such as: oscillator count, oscillator type, filter type, filter frequency and resonance, parameters, low frequency oscillator parameters effects parameters such as: reverb parameters, delay parameters, equalisation parameters, compression parameters, filter parameters These parameters may also be included in the output metadata.

One important aspect of the examples of the invention described herein comprises the ability for machine learning of the metadata that leads to successful outcomes. The logging of analytics data 54 by an analytics module 56 allows user actions in response to generated music instances or audio tracks to be assessed. The analytics module may score audio outputs according to: whether a user discards a generated audio file after one listen; whether a user repeats playback one or more times; whether a user saves/keeps an output audio file; whether a user reopens or exports an output audio file into an associated music production module/program.

Thus it will be appreciated that the auditable metadata trail allows continual assessment of the outcomes of the pseudo-random music generation system so as to reduce the likelihood of outcomes that are entirely unsuccessful. The invention may still have at its core a random selection of candidate notation and audio files but may update the algorithms to add additional search and/or compatibility criteria, prior to generating a music instance. Criteria for improved likelihood of success may be implemented by the 'randomness' selector such that the user still has the ability to produce wildly varying audio outputs, whilst also having the option to narrow the scope of results to more conventionally acceptable or pleasing music outputs.

The invention claimed is:

1. A system for generating music content comprising:

a music notation data store comprising a collection of notation data files, an audio data store comprising a collection of audio data files, each data file in the notation and audio data stores comprising associated music characteristic metadata, one or more processor arranged to receive user music preference inputs from a user interface and to search the notation and audio data stores to identify a plurality of data files corresponding to one or more user preference input, the processor randomly selecting at least one notation file and at least one audio file from the identified notation and audio files and generating a music instance file by combining of the selected notation and audio files for playback to the user, and a user input randomness parameter, the value of said parameter determining the degree of the match required between a notation metadata parameter and an audio file metadata parameter prior to permitting music instance generation from said audio and notation files.

2. The system of claim 1, comprising a search module, a music instance generation module and an analytics module, the analytics module assessing the generated music instance file or one or more tracks thereof according to a user interaction with the music instance file or one or more track thereof via a user interface.

3. The system of claim 2, wherein the analytics module ranks the success of the generated music instance file according to the number or type of user interactions therewith once generated and logs one or more metadata attribute thereof for each of the selected audio file and notation file selected by the one or more processor from the respective data store searches.

4. A data carrier comprising machine readable code for operation of one or more computer processor to generate music content by:

receiving one or more user music preference input, searching a music notation data store comprising a collection of notation data files and an audio data store comprising a collection of audio data files, wherein each data file in the notation and audio data stores comprising associated music characteristic metadata and the searching comprises searching for metadata corresponding to the one or more user music preference input, identifying a plurality of data files corresponding to one or more user preference input, randomly selecting at least one notation file and one audio file from the identified notation and audio files, generating a music instance file from the combination of the selected notation and audio files for playback to the user, and implementing a user input randomness parameter, the value of said parameter determining the degree of the match required between a notation metadata parameter and an audio file metadata parameter prior to permitting music instance generation from said audio and notation files.

5. The data carrier of claim 4, wherein the one or more computer processor outputs metadata with the music instance file, the music instance metadata comprising at least one metadata element from the at least one selected notation file and at least one metadata element from the at least one selected audio file, such that the music instance metadata provides an auditable record for the notation and audio files used in the music instance generation.

6. The data carrier of claim 5, wherein the one or more computer processor logs the user preference inputs resulting in the music instance generation as one or more metadata entry with the generated music instance file.

7. The data carrier of claim 4, wherein the one or more computer processor identifies a set of candidate notation and/or audio files from the search process and reduces the number of identified candidate files subjected to the random selection process using one or more filtering criterion.

8. The data carrier of claim 4 wherein the search process comprises searching for one or more notation file comprising a plurality of notation tracks and selecting one or a plurality of notation tracks from the one or more notation file.

9. The data carrier of claim 4, wherein the notation file comprises notation data defining a melody to be played and the one or more computer processor overlays the at least one audio file onto the notation file according to the notation data.

10. The data carrier of claim 4, wherein each notation file comprises a plurality of timing features or elements and the one or more computer processor applies an audio file or sample at each timing element when generating the music instance file.

11. The data carrier of claim 10, wherein the notation file comprises a plurality of notation tracks and the one or more computer processor applies a selected audio file to each timing element of a first notation track in order to create a first audio track of the music instance file and applies the same or a further audio file to each timing element of a second notation track in order to create a second notation track of the music instance file.

12. The data carrier of claim 4, wherein the audio file comprises an instrument sample.

13. The data carrier of claim 4, wherein the one or more computer processor checks the metadata of the audio file and notation file resulting from the random selection process and discards the audio and notation file combination if the combination matches the metadata stored for a previously generated music instance file.

14. A data carrier comprising machine readable code for operation of one or more computer processor to generate music content by:

receiving one or more user music preference input, searching a music notation data store comprising a collection of notation data files and an audio data store comprising a collection of audio data files, wherein each data file in the notation and audio data stores comprising associated music characteristic metadata and the searching comprises searching for metadata corresponding to the one or more user music preference input, identifying a plurality of data files corresponding to one or more user preference input, randomly selecting at least one notation file and one audio file from the identified notation and audio files, generating a music instance file from the combination of the selected notation and audio files for playback to the user, assessing the generated music instance file or one or more tracks thereof according to a user interaction with the music instance file or one or more track thereof via a user interface, ranking the success of the generated music instance file according to the number or type of user interactions therewith once generated, and logging one or more metadata attribute thereof for each of the selected audio file and notation file selected by the processor from the respective data store searches.

15. The data carrier of claim 4, wherein each audio and/or notation file comprises metadata indicative of a file characteristic comprising one or more of: a music type, genre, style or emotion, an instrument type and/or one or more measurable/numerical parameter, such as frequency, pitch, duration, bit rate, sample rate or number of channels.

16. The data carrier of claim 14, comprising a user input randomness parameter, the value of said parameter determining the degree of the match required between a notation metadata parameter and an audio file metadata parameter prior to permitting music instance generation from said audio and notation files.

* * * * *